United States Patent [19]

Arentsen

[11] Patent Number: 4,964,473

[45] Date of Patent: Oct. 23, 1990

[54] METHOD FOR DRIVING A HYDRAULIC SUBMERGED TOOL

[75] Inventor: Dik Arentsen, Leiderdorp, Netherlands

[73] Assignee: IHC Holland N.V., Sliedrecht, Netherlands

[21] Appl. No.: 322,835

[22] Filed: Mar. 14, 1989

[30] Foreign Application Priority Data

Mar. 15, 1988 [NL] Netherlands ..... 8800632

[51] Int. Cl.[5] ..... E02D 7/10

[52] U.S. Cl. ..... 173/1; 173/52; 173/DIG. 1; 173/DIG. 4; 175/6

[58] Field of Search ..... 173/1, 52, 116, DIG. 1, 173/DIG. 4; 175/6; 405/228

[56] References Cited

U.S. PATENT DOCUMENTS

| | | | |
|---|---|---|---|
| 3,800,548 | 4/1974 | Wisotsky | 173/1 X |
| 3,820,346 | 6/1974 | Wisotsky | 173/1 X |
| 3,821,992 | 7/1974 | Matsuo | 173/116 |
| 3,824,797 | 7/1974 | Wisotsky | 173/1 X |
| 3,842,917 | 10/1974 | Wisotsky | 173/1 X |
| 4,043,405 | 8/1977 | Kuhn | 173/127 |
| 4,131,164 | 12/1978 | Hague et al. | 173/1 |
| 4,211,291 | 7/1980 | Kellner | 173/DIG. 4 X |
| 4,279,313 | 7/1981 | Jansz | 173/112 |
| 4,526,239 | 9/1985 | Kaneda et al. | 173/DIG. 1 X |
| 4,601,349 | 7/1986 | Arentsen | 173/116 |
| 4,650,008 | 3/1987 | Simson | 173/116 X |
| 4,742,876 | 5/1988 | Barthelemy et al. | 175/7 |

FOREIGN PATENT DOCUMENTS

| | | |
|---|---|---|
| 2588297 | 4/1987 | France . |
| 7513240 | 5/1976 | Netherlands . |
| 1470956 | 4/1977 | United Kingdom . |
| 2069034 | 8/1981 | United Kingdom . |

*Primary Examiner*—Frank T. Yost
*Assistant Examiner*—Rinaldi Rada
*Attorney, Agent, or Firm*—Foley & Lardner, Schwartz, Jeffrey, Schwaab, Mack, Blumenthal & Evans

[57] ABSTRACT

Method for driving a hydraulic submerged tool whereby the hydraulic pressure energy is generated in a submerged power converter, being driven by pressurized surrounding water which after the energy transfer is exhausted into the surrounding water, said power converter consisting of one or more work cylinders (1, 2), each by means of a floating piston (3, 4) being divided in a space (5, 6) filled with the pressurized surrounding water and a space (7, 8), filled with a hydraulic work medium, switching means (17, 18) being provided, for alternately connecting said space (5, 6) either to a feed conduct (13) for pressurized surrounding water, or to an exhaust (14).

11 Claims, 3 Drawing Sheets

METHOD FOR DRIVING A HYDRAULIC SUBMERGED TOOL

Figure 1:
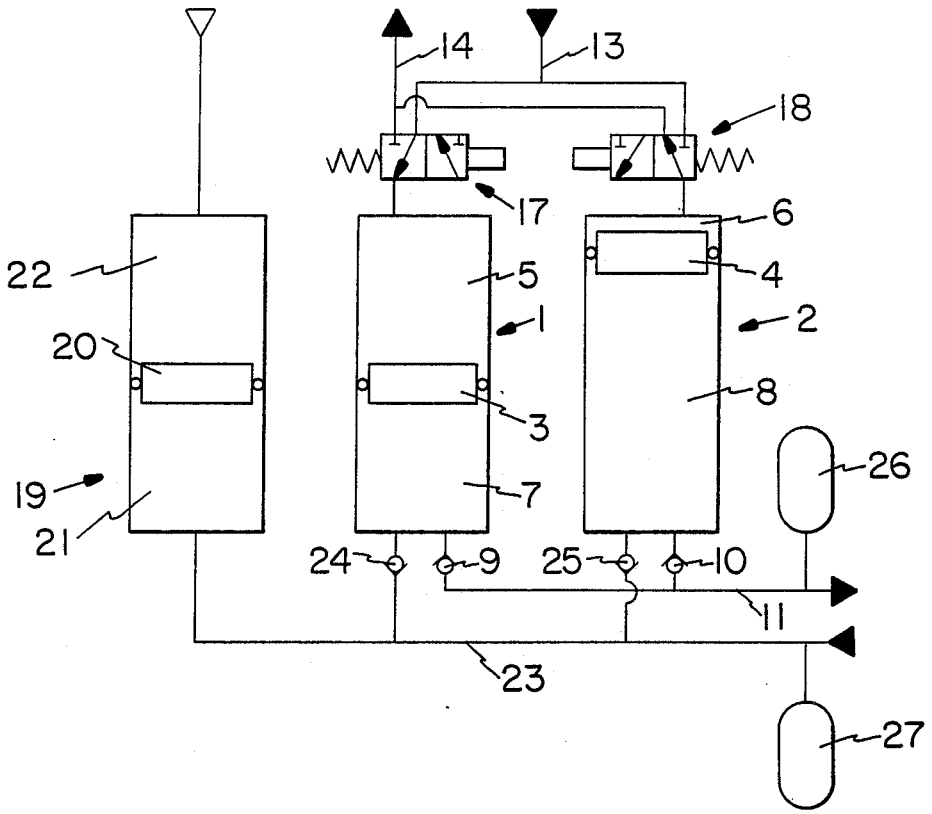

The invention relates to a method for driving a hydraulic submerged tool, whereby the hydraulic pressure energy is generated in a submerged power converter.

Such a method is known from the Netherlands patent application Nr. 7513240.Herewith the submerged tool is a hydraulically driven pile driver to which an electrically driven hydraulic power unit is attached inwhich electric power is converted into hydraulic power. Feeding this power converter occurs by supplying electric energy by electric cables to the power converter from a generator located above water ashore, or on a ship or on a work platform. In the same way other submerged tools are driven, such as drilling tools, sampling apparatuses and tools for working at or inspecting submarine constructions.

The electrical cables are uncoiled from a reel on deck to follow the power converter lowered below the water. For work ships with their restricted deck space and hoisting capacity suchlike reels with cables and diesel-electric power units are very aggravating.

Further, with an increase of the depth on which has to be worked, extension of the electric cables is almost impossible or very complicated, because in most cases these are combined cables for electrical power, electrical signals and air supply. These cables moreover are rather heavy, costly and vulnerable.

The invention aims to provide a method as well as a device for driving a hydraulic submerged tool with which these problems can be solved in an easy way.

According to the invention this object is obtained by driving the converter with pressurised surrounding water which after the energy transfer is exhausted into the surrounding water.

Herewith a simple drive is obtained whereby no return conduct is necessary. Especially with drilling-ships in which high-pressure sea water pumps are already present and in which the drilling pipe composed of sections also can be used for transporting the pressurised sea water, this method will give a considerable cost reduction, whereas the working depth may be very large.

It is remarked that it is known per se to use surrounding water as hydraulic work medium, but here the surrounding water is used as an energy transferring medium.

According to the invention an energy transfer with a very high efficiency is obtained because the power, which is stored in the pressurised surrounding water is directly transferred to the hydraulic work medium.

The power converter for carrying out the inventive method is lowered below the water by hoisting means and is characterized in that the power converter consists of one or more work cylinders which each by means of a floating piston are divided in a space filled with pressurised surrounding water and a space filled with a hydraulic work medium, switching means being provided which are activated each time that a floating piston reaches the end of its work stroke, by reason of which at each work cylinder the space which can be filled with pressurised surrounding water alternately is connected either to a feed conduct of pressurised surrounding water or to a free exhaust, each work cylinder at the side of the hydraulic work medium being connected to the pressure conduct running to the tool. By this with a relatively simple device a practically loss free energy conversion is realized. Alternatingly switching from the translating work cylinders onto the feed conduct of high pressurised surrounding water results in a continuous fluctuating or not fluctuating flow of hydraulic work medium.

The switching means which are activated each time a floating piston in a work cylinder reaches the end of the work stroke can for instance consist of approach switches or sensors which are mounted in the wall of the work cylinder and which transmit a switching command which can control a suitable valve.

In order to absorb possible volume changes or a small loss in the circuit of a hydraulic work medium and to promote pressing the surrounding water out of a non pressurised work cylinder at the end of the work stroke, the power converter according to the invention may further be provided with one or more store cylinders in which an overpressure with respect to the surroundings reigns and which are partly filled with the hydraulic work medium and are connected with the return conduct of the tool.

The above mentioned over pressure in the store cylinders can in a simple way be realized in that according to the invention the store cylinders preferably are provided with a floating piston on which spring means work such as for instance a pressurised gas.

The floating piston prevent that this gas dissolves in the hydraulic work medium.

By the restricted number of simple members from which the power converter is constructed and the high rate of freedom of the possibilities of location of the converter members with respect to each other and with respect to the tool to be driven many configurations are possible. So it can be advantageously that according to the invention the converter forms externally or internally one unit with the tool.

According to the invention it is also possible that one or more work cylinders are located within a store cylinder. With these configurations the vulnerability of conducts and accessories can be reduced to a consirable extend.

It is conceivable that the pressure of the pressurised surrounding water is much lower or much higher than the needed pressure of the hydraulic work medium.

Than it is according to the invention preferred that the floating pistons in the work cylinders are constructed as differential pistons. By reason of the differing piston areas at the side of the surrounding liquid and that of the hydraulic work medium the work cylinders in that case work also as pressure transformers.

An exceptionally compact construction can be obtained in that according to a further elaboration of the invention the power converter consists of one or more pairs of work cylinders which are located in line whereby the spaces with are filled with the hydraulic work medium are adjacent to each other,and between both floating pistons a link being mounted which is movable in the longitudinal direction of the cylinders. This link which not necessarily needs to be attached to one or both floating pistons sees to it that during the work stroke of the one work cylinder the piston in the opposing work cylinder is forced to carry out an intake stroke, by reason of which this cylinder is again filled with the hydraulic work medium. With this construction the store cylinders can possibly be left out if in the hydraulic work circuit a sufficiently large dimensioned high pressure accumulator is provided.

With a favourable embodiment of the invention the supply conduct of the pressurised surrounding water can be combined with the hoisting means with which the power converter is lowered under the water. This embodiment may be especially applicable with drilling ships,in which the drilling pipe composed of sections also serve the purpose of supply conduct of the pressurised surrounding water.

The invention now will be further elucidated on hand of the drawings in which some examples of embodiments of the invention are shown.

FIG. 1 schematically shows a vertical cross section through an embodiment of the power converter according to the invention.

Figure 2:
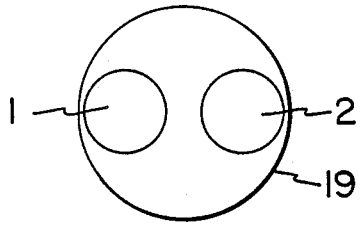

FIG. 2 schematically shows another embodiment of the power converter in cross section, the hydraulic scheme being left out.

Figure 3:
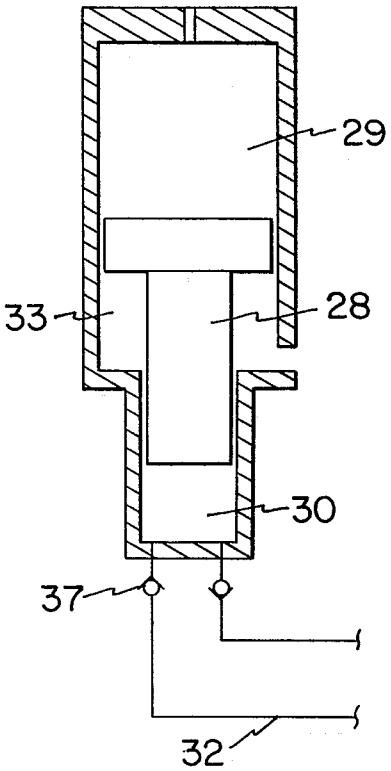

FIG. 3 schematically shows another embodiment of a work cylinder in longitudinal section.

Figure 4:
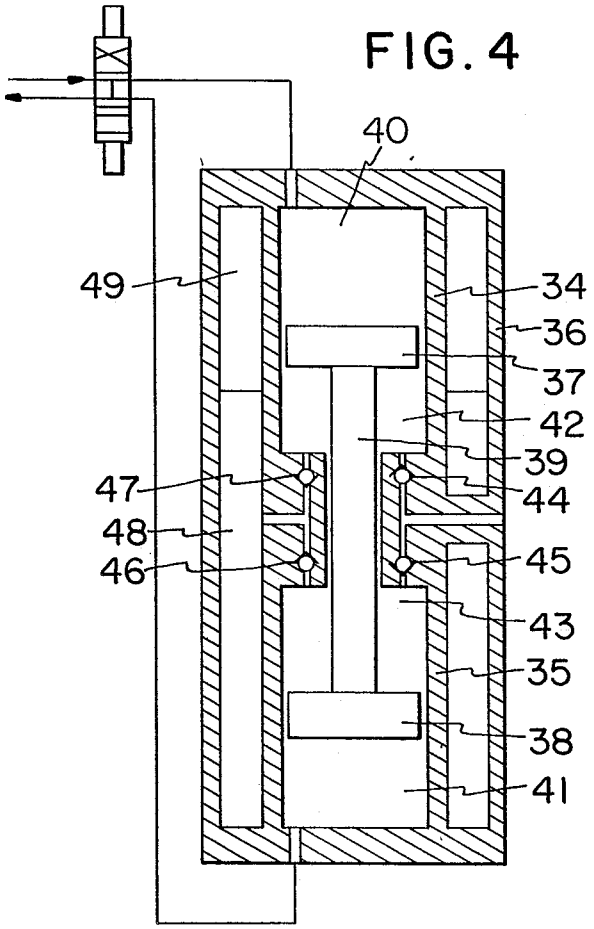

FIG. 4 schematically shows another embodiment of the power converter according to the invention in longitudinal cross section.

Figure 5:
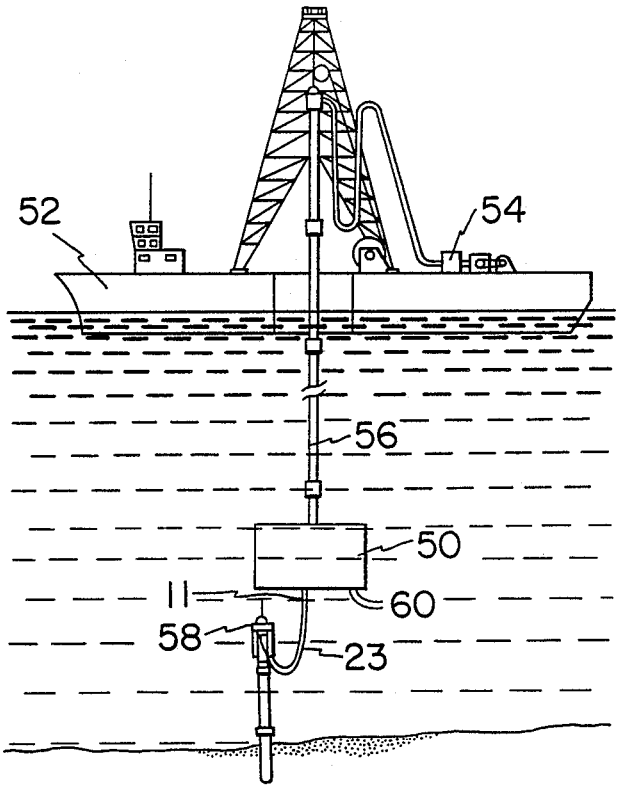

FIG. 5 shows a power converter according to the present invention in use with a drilling ship.

The power converter shown in FIG. 1 consists of two work cylinders 1 and 2 which each by a floating piston 3 and 4 resp. are divided in a variable space 5 and 6 resp. which can be filled with pressurised surrounding water, and a variable space 7 and 8 resp., which is filled with the hydraulic work medium with which the tool is driven and which spaces via one way valves 9 and 10 are connected to a pressure conduct 11 to a not further shown tool. By means of switching means the pressurised water spaces 5 and 6 can alternatingly be connected either to a supply conduct,13 of pressurised surrounding water, or to a free exhaust 14 toward the surroundings. The switching means consist in approach switches located near the end positions of the work stroke of the floating piston or sensors, which, each time the floating piston 3, 4, reaches the end of its work stroke in a work cylinder 1, 2 give a switching, which controls the switching valve 17 or 18 of the related cylinder. The mentioned approach switches can be mounted as well at the end of the side wall of the spaces 7, 8 as in the end wall of the spaces 7, 8. The switching command may be mechanical, hydraulical or electrical.

The switching valve 17, 18 can in stead of a 3/2 valve, as shown in FIG. 1 also be a 3-positions valve with three connections, or two valves switching independently from each other, a switching position being present in which the conduct 13 is immediately switched on the exhaust 14 for a free pass way.

The power converter shown in FIG. 1 is further provided with a store cylinder 19, which by means of a floating piston 20 is divided in a space 21, which is filled with the hydraulic work medium and via a conduct 13 can be connected to the return conduct of a tool not further shown, and a space 22 in which a gas is present having a higher pressure than the surroundings. The conduct 23 is also connected to the spaces 7, 8 of the work cylinders 1, 2, filled with the hydraulic work medium via one way valves 24 and 25.

In FIG. 1 the surrounding pressure water is connected to the pressurised water space 5 of the work cylinder 1 via the switching valve 17. As a consequence of this the floating piston 3 carries out a work stroke and presses the hydraulic work medium to the tool via the one way valve 9 and the pressure conduct 11. During this work stroke of the work cylinder 1 the valve 18 has been switched in such a way, that the pressurised water space 6 of work cylinder 2 is connected to the free exhaust 14 toward the surroundings. The pressurised water now can be pressed out of the space 6 by the floating piston 4 under influence of the low pressure return flow from the tool and/or the hydraulic work medium which is present in the space 21 of the store cylinder 19 and has an over pressure with respect to the surroundings. Herewith via the conduct 23 and the one way valve 25 the space 8 is again filled with the hydraulic work medium. At the end of the work stroke of the floating piston 3 an approach switched is activated, by reason of which valves 17 and 18 are reversed. Now the floating piston 4 in the work cylinder 2 carries out a work stroke, whereas the space 7 in the work cylinder 1 is filled with the hydraulic work medium via the one way valve 24 during the intake stroke. At the end of this work stroke the valves 17 and 18 are reversed by an approach switch mounted in the work cylinder 2. In this manner a continuous fluctuating or not fluctuating flow of hydraulic work medium is obtained. By the application of more than two work cylinders and/or having the work strokes overlapping the fluctuations can be reduced. In the pressure conduct 11 and the return conduct 23 an accumulator 26, 27 can be located for absorbing pressure variations or strong variations of liquid flows. In the scheme the further components such as safety valves, coolers, filters and so on have been left out because they are not of principal interest for the invention.

It is conceivable to use only one work cylinder in combination with a sufficiently large dimensioned high pressure accumulator.

The power converter according to FIG. 2 consists of two work cylinders 1, 2 which are located inside the store cylinder 19.

FIG. 3 shows an embodiment of a work cylinder in which the floating piston 28 has been carried out as a differential piston. The space 29 above the piston can alternately be connected either to a supply conduct of pressurised surrounding water or to a free exhaust to the surroundings by means of switching means.The space 30 is filled with the hydraulic work medium which during the downward work stroke of the piston is pressed under high pressure to the tool via the one way valve 31 and the pressure conduct 32. Herewith the pressing pressure of the work medium can be much higher than the pressure of the pressurised water. During the intake stroke of the piston 28 the space 33 can be filled with pressurised surrounding water or with surrounding water under surrounding pressure or with low pressure hydraulic work medium from the return conduct of the tool or with high pressure hydraulic work medium.

FIG. 4 shows an embodiment of the power converter in which two work cylinders 34 and 35 are located in line with each others,whereas the combination is surrounded by a coaxial store cylinder 36. In this embodiment the two floating pistons 37 and 38 are coupled by a link 39 which needs not exclusively to be connected to one or both floating pistons. The spaces 40 and 41 can be alternatingly connected either to a supply conduct of pressurised surrounding water or a free exhaust toward the surroundings, by means of switching means. The spaces 42 and 43 are filled with the hydraulic work medium which during the work stroke of the related piston 37, 38 is pressed under high pressure via one way valves 44 and 45 toward the tool. The mechanical coupling between both pistons 37 and 38 causes that during a work stroke of for instance piston 37 the piston 38 is carrying out an intake stroke, while the space 43 is filled with hydraulic work medium from the space 48 of the store cylinder 36 via the one way valve 46. In the space 49 above the space 48 a medium, for instance a gas, is present with an over pressure with respect to the surroundings.

FIG. 5 shows a power converter 50 according to the present invention in use with a drilling ship 52. A power source, such as pump 54, is located on the drilling ship 52 and supplies power through a pressurized surrounding water feed conduct 56, which also serves as a hoisting means. The power converter 50 is attached to a tool, such as pile driver 58 through return line 23 and pressure conduct 11. Pressurized surrounding water is exhausted from the power converter 50 through exhaust means 60.

It will be obvious that the invention is not restricted to the embodiments described in the above, which within the scope of the invention can be varied in different manners.

I claim:

1. A method for driving a hydraulic tool submerged in surrounding water comprising:

providing one or more work cylinders, each of said cylinders being divided by a floating piston into a first and second space;

filling said first space with pressurized surrounding water;

filling said second space with a hydraulic work medium;

reciprocating said floating piston in said work cylinder;

alternately connecting said first space to one of a feed conduct for pressurized water and a free exhaust each time said floating piston reaches the end of its work stroke;

operatively connecting said second space to the tool through a pressure conduct; and driving the tool with said hydraulic work medium.

2. The method according to claim 1, further comprising:

filling one or more store cylinders with hydraulic work medium.

3. The method according to claim 2, further comprising:

pressurizing said store cylinders to a pressure higher than the surroundings.

4. The method according to claim 3, further comprising:

operatively connecting said store cylinders via a return conduct to said tool.

5. A power converter for driving a tool submerged in surrounding water comprising:

one or more work cylinders, each of said work cylinders being divided by a floating piston into a first space filled with pressurised surrounding water and a second space filled with a hydraulic work medium;

switching means operatively connected with said work cylinders, which are activated each time that the floating piston reaches the end of its work stroke, so that at each work cylinder the first space is alternately connected to one of a feed conduct for pressurized surrounding water or a free exhaust; and a pressure conduct connected to each work cylinder at the side of the hydraulic work medium, said pressure conduct being connected via one way valves.

6. Power converter according to claim 5, further comprising:

one or more store cylinders having a higher pressure with respect to the surroundings; said store cylinders being partially filled with the hydraulic work medium, said store cylinders being connected via a return conduct to the tool.

7. Power converter according to claim 5, wherein each of the store cylinders is divided by a floating piston, said floating pistons being operated on by a spring means.

8. Power converter according to claim 5, wherein the floating pistons in the work cylinders are differential pistons.

9. Power converter according to claim 5, wherein said work cylinders are formed in pairs and located in line, said second spaces which are filled with the hydraulic work medium are in fluid communication with each other, and between each pair of floating pistons a connecting link is formed which is movable in a longitudinal direction of the work cylinders.

10. Power converter according claim 5, wherein one or more work cylinders is located within a store cylinder.

11. A drilling ship comprising:

a power converter for driving a tool submerged in surrounding water, said power converter comprising:

(a) one or more work cylinders, each of said work cylinders being divided by a floating piston into a first space filled with pressurised surrounding water and a second space filled with a hydraulic work medium;

(b) switching means operatively connected with said work cylinders, which are activated each time that the floating piston reaches the end of its work stroke, so that at each work cylinder the first space is alternately connected to one of a feed conduct for pressurised surrounding water or a free exhaust; and (c) a pressure conduct connected to each work cylinder at the side of the hydraulic work medium, said pressure conduct being connected via one way valves;

high pressure pumps for pressurising the surrounding water; and a drilling pipe for transporting the pressurised water to the power converter.

* * * * *